United States Patent [19]

Beno

[11] Patent Number: 4,957,025

[45] Date of Patent: Sep. 18, 1990

[54] PAPER TRIMMER

[76] Inventor: Steven J. Beno, c/o Ideal School Supply Corp., 2245 Delany Rd., Waukegan, Ill. 60087

[21] Appl. No.: 326,914

[22] Filed: Mar. 22, 1989

[51] Int. Cl.[5] ..... B26D 5/10

[52] U.S. Cl. ..... 83/607; 83/468; 83/701

[58] Field of Search ..... 83/167, 468, 585, 607, 83/609, 701; 108/25, 26; 227/76, 67, 156; 248/346; 269/289 R, 296, 900

[56] References Cited

U.S. PATENT DOCUMENTS

| | | | |
|---|---|---|---|
| 215,205 | 5/1879 | Bradley | 83/585 |
| 776,355 | 11/1904 | Selander | 108/25 X |
| 1,803,830 | 5/1931 | Arey et al. | 108/25 X |
| 1,867,768 | 7/1932 | Schulzke | 108/25 |
| 1,906,213 | 4/1933 | Neuschotz et al. | 108/25 |
| 2,103,217 | 12/1937 | Ford | 83/585 |
| 2,254,374 | 9/1941 | Laukhuff | 83/585 X |
| 2,256,606 | 9/1941 | Blanc | 83/585 X |
| 2,345,450 | 3/1944 | Blanc | 83/607 X |
| 4,354,601 | 10/1982 | Harrison | 108/25 A |
| 4,807,538 | 2/1989 | Hoffman | 108/25 |

*Primary Examiner*—Paul A. Bell

*Attorney, Agent, or Firm*—Wood, Phillips, Mason, Recktenwald & Van Santen

[57] ABSTRACT

A paper trimmer having a base cover and cutter blade handle formed of molded synthetic resin. The base defines a plurality of upwardly opening recesses. The cover is pivotally mounted to the base for selectively closing one or more of the recesses. The base includes a support wall immediately subjacent the cutting edge of the fixed cutter blade mounted thereto for improved long, troublefree cutting operation by the paper trimmer.

19 Claims, 1 Drawing Sheet

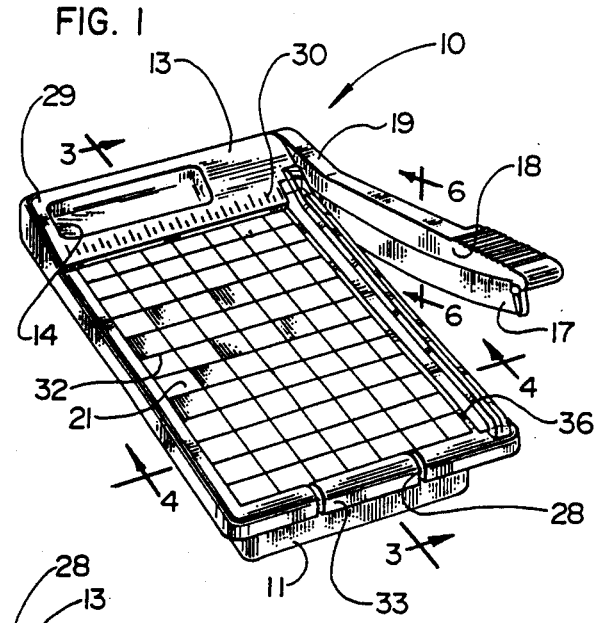
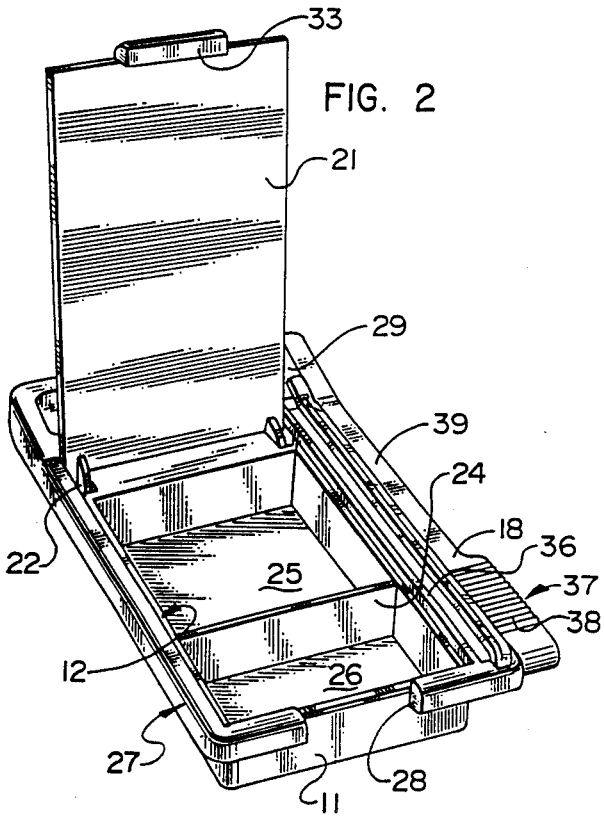
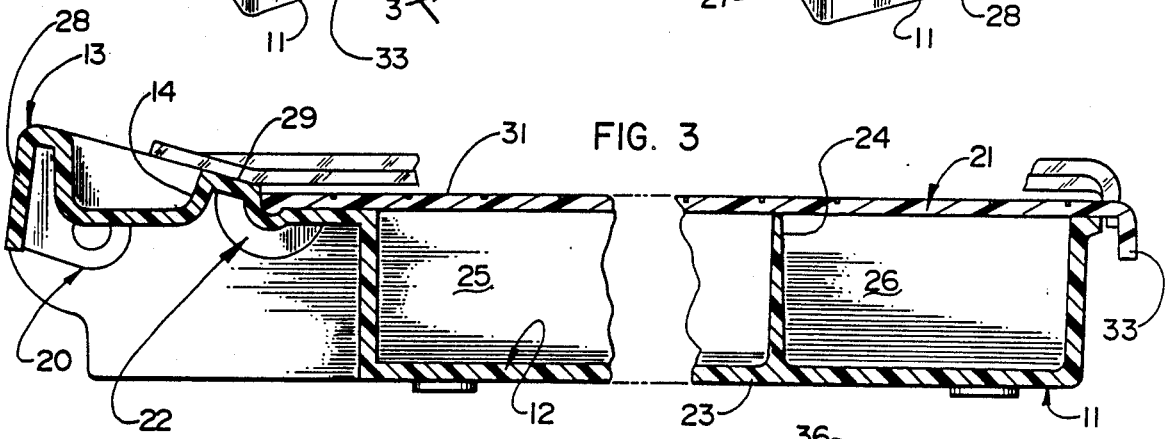
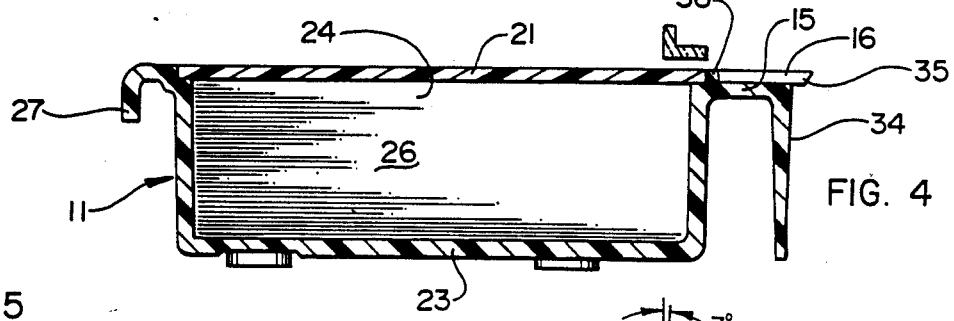
FIG. 4
FIG. 5
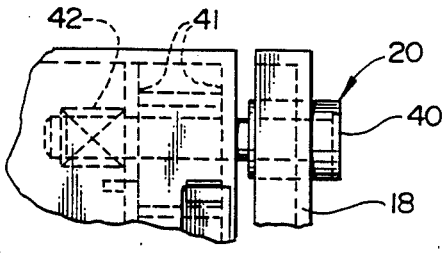
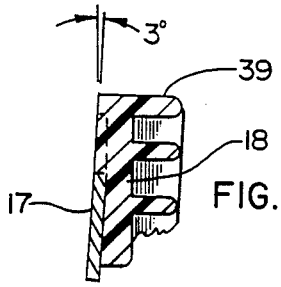
FIG. 6

PAPER TRIMMER

TECHNICAL BACKGROUND

This invention relates to paper trimmers and in particular to paper trimmers having a pivotal knife blade at one edge of a paper support base.

BACKGROUND ART

One form of conventional paper trimmer comprises a base having a knife blade pivotally mounted to one edge of the base. A fixed blade is disposed at the edge of the base to cooperate with the knife blade in cutting paper extending outwardly from the fixed blade.

It is conventional to form such bases of relatively massive and solid material. One common material used for such bases is wood.

DISCLOSURE OF INVENTION

The present invention comprehends an improved paper trimmer which is lightweight, low cost, and which provides for readily removable storage of small office supplies, such as paper clips, staples, etc.

More specifically, the invention comprehends the provision of such an improved paper trimmer including a base having a front portion defining a first upwardly opening recess, a rear portion defining a second upwardly opening recess, an edge portion, a cover removably overlying the first recess, a fixed cutter blade on the base edge portion and defining a top surface, and an outer, first cutting edge, and a movable cutter blade pivotally mounted to said base and defining a lower, second cutting edge arranged to cut paper extending outwardly from the top surface of the fixed cutter blade.

The base, in the illustrated embodiment, is provided with an upstanding wall means for dividing the first recess into a plurality of upwardly opening compartments.

The fixed cutter blade cutting edge projects outwardly from the base edge portion.

In the illustrated embodiment, the base defines a bottom wall and the base edge portion includes an outer, downturned vertical wall extending downwardly to the level of the bottom wall for supporting the fixed cutter blade adjacent the first cutting edge thereof.

In the illustrated embodiment, the base is provided with an upstanding wall in the first recess for supporting the cover when the cover is disposed in a closed position across the recess.

The rear portion of the base defines a forwardly inclined upper surface through which the second recess opens, in the illustrated embodiment.

In the illustrated embodiment, the base defines a horizontal bottom wall at the bottom of the second recess.

In the illustrated embodiment, the second recess has a width transversely of the base less than the width transversely of the base of the first recess.

The base includes a downturned wall at the rear of the rear portion thereof.

In the illustrated embodiment, the base defines an upwardly facing ledge extending about the first recess, and the cover defines a peripheral edge portion resting on the ledge in a closed position of the cover across the first recess.

The cover includes a front portion having a distal downturned wall disposed forwardly of the base in a closed position of the cover across the first recess.

In the illustrated embodiment, the base is provided with an upstanding wall inwardly adjacent the edge portion and the cover and fixed cutter blade have a thickness substantially equal to the height of the upstanding wall, whereby the top surface of the fixed cutter blade, the top surface of the divider wall, and the top surface of the cover are coplanar when the cover is in a closed position across the first recess.

In the illustrated embodiment, the base is formed of a molded synthetic resin. The upstanding wall may be molded integrally therewith. The movable cutter blade is mounted to a handle formed of molded synthetic resin pivotally mounted to the rear portion of the base.

The fixed and movable cutter blades, in the illustrated embodiment, are formed of metal.

The paper trimmer of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a paper trimmer embodying the invention;

FIG. 2 is a perspective view similar to that of FIG. 1, but with the cover in an open position;

FIG. 3 is a fragmentary enlarged longitudinal section taken substantially along the line 3—3 of FIG. 1;

FIG. 4 is an enlarged transverse section taken substantially along the line 4—4 of FIG. 1;

FIG. 5 is a fragmentary plan view of a corner of the paper trimmer illustrating the mounting of the movable blade handle pivotally to a rear portion of the base; and FIG. 6 is an enlarged transverse section taken substantially along the line 6—6 of FIG. 1.

BEST MODE FOR CARRYING OUT THE INVENTION

In the illustrative embodiment of the invention as disclosed in the drawing, a paper trimmer generally designated 10 is shown to comprise a base 11 defining a first, upwardly opening recess 12 and a rear portion 13 defining a second, upwardly opening recess 14.

The base further defines an edge portion 15 on which is disposed a fixed cutter blade 16.

A movable cutter blade 17 is mounted to a handle 18 having a rear portion 19 pivotally mounted to rear portion 13 of the base by a pivot means generally designated 20.

A cover 21 is swingably mounted to the base for selective positioning in a closed position across the recess 12, as shown in FIG. 1, and in an open position upstanding from the base, as shown in FIG. 2. The cover is swingably mounted to the base by means of a pivot connection generally designated 22.

Base 11 further defines a bottom wall 23 defining the bottom of the recess 12, and at least one upstanding wall, such as wall 24, dividing the upwardly opening space 12 into a plurality of compartments, such as compartments 25 and 26 shown in FIG. 3.

Base 11 further defines a downturned peripheral flange 27 extending fully about the upper portion of the base except for a gap 28 at a front portion thereof. The portion 28 of the flange extending across the rear of the base is elongated to extend substantially to the level of the flange along the sides of the base. The rear portion of the base, as seen in FIG. 3, defines a forwardly upwardly inclined top surface 29 through which the recess 14 opens, as seen in FIGS. 1 and 3. The width of recess 14 transversely of the trimmer is less than the width of the recess 12 transversely thereof, in the illustrated embodiment. As shown in FIG. 1, recess 14 may be disposed at one side of the rear portion 13.

As further shown in FIG. 1, the top surface 29 of the rear portion may be provided with a scale 30 for use in positioning paper on the cover 21 during a paper trimming operation. As shown, the upper surface 31 of the cover is provided with a grid 32 for use in the paper positioning.

The front portion of cover 21 is provided with a downturned manipulating flange received in the gap 28 of the base peripheral flange 27, when the cover is in the closed position, as shown in FIGS. 1 and 3.

The base peripheral flange includes an elongated side portion 34 extending down to the level of the bottom wall 23 to serve as an outboard support for the edge portion 15 of the base, as seen in FIG. 4. As further shown in FIG. 4, fixed cutter blade 16 defines an edge portion 35 which is cantilevered outwardly from the edge portion 15 of the base.

As further illustrated in FIG. 4, the base includes an upstanding wall 36 on the edge portion 15. The thickness of cover 21, the height of upstanding wall 36, and the thickness of blade 16, as shown in FIG. 4, are similar so that the top surfaces thereof are coplanar.

Handle 18 includes a distal end portion 37 provided with striations 38 for facilitated finger engagement for swinging the movable cutter blade 17 downwardly in effecting a paper trimming operation and upwardly in disposing the handle in a retracted disposition prior to the cutting operation. As seen in FIG. 2, the handle 18 defines an upper surface 39 which is effectively coplanar with the upper surface of the cutter blade 16 and the upper surface 29 of the rear portion of the base when the handle is in the downward extreme position, as shown in FIG. 2.

As shown in FIG. 6, cutter blade 17 is preferably mounted to the handle 18 to extend at a slight angle to the vertical, such as 320 , for improved, positive cutting of the paper in a paper trimming operation.

As shown in FIG. 5, the pivot means 20 includes a pivot axle structure 40 rotatable in wall portions 41 of the base. The pivot means may include a spring 42 for yieldably biasing the cutter blade 17 relative to the fixed cutter blade 16 for improved cutting action.

Base 11, cover 21, and handle 18 are preferably formed of molded synthetic resin for providing a low cost, light-weight, rugged paper trimmer structure. The cutter blades are preferably formed of metal for providing long life, sharp cutting edges. The pivots 20 and 22 are illustrative and, as will be obvious to those skilled in the art, any suitable pivot means may be utilized in pivoting the handle and cover to the base within the broad scope of the invention.

The foregoing disclosure of specific embodiments is illustrative of the broad inventive concepts comprehended by the invention.

I claim:

1. A paper trimmer comprising:

a base having a front portion defining a first upwardly opening recess, a rear portion defining a second upwardly opening recess, and an edge portion;

a cover removably overlying said first recess;

a fixed cutter blade on said base edge portion and defining a top surface and an outer, first, cutting edge; and a movable cutter blade pivotally mounted to said base and defining a lower, second cutting edge arranged to cut paper extending outwardly from said top surface of said fixed cutter blade.

2. The paper trimmer of claim 1 wherein said base is provided with upstanding wall means for dividing said first recess into a plurality of upwardly opening compartments.

3. The paper trimmer of claim 1 wherein said fixed cutter blade cutting edge projects outwardly from said base edge portion.

4. The paper trimmer of claim 1 wherein said base defines a bottom wall and said base edge portion includes an outer, downturned vertical wall extending downwardly to the level of said bottom wall for supporting said fixed cutter blade adjacent said first cutting edge thereof.

5. The paper trimmer of claim 1 wherein said base is provided with an upstanding wall in said first recess, said upstanding wall being arranged to support said cover in a closed position thereof extending across said recess.

6. The paper trimmer of claim 1 wherein said rear portion of the base defines a forwardly inclined upper surface through which said second recess opens.

7. The paper trimmer of claim 1 wherein said rear portion of the base defines a forwardly inclined upper surface through which said second recess opens, said base defining a horizontal bottom wall at the bottom of said second recess.

8. The paper trimmer of claim 1 wherein said second recess has a width transversely of said base less than the width transversely of said base of said first recess.

9. The paper trimmer of claim 1 wherein said base includes a downturned wall at the rear of said rear portion thereof.

10. The paper trimmer of claim 1 wherein said base defines an upwardly facing ledge extending about said first recess and said cover defines a peripheral edge portion resting on said ledge in a closed position of the cover across said first recess.

11. The paper trimmer of claim 1 wherein said cover includes a front portion having a distal downturned wall disposed forwardly of said base in a closed position of the cover across said first recess.

12. A paper trimmer comprising:

a base having a front portion defining a first upwardly opening recess, a rear portion defining a second upwardly opening recess, and an edge portion;

an upstanding wall on said base inwardly of said edge portion;

a cover removably overlying said first recess;

a fixed cutter blade on said base edge portion and defining a top surface and an outer, first, cutting edge, said cover and said fixed cutter blade having a thickness substantially equal to the height of said upstanding wall, said top surface of the fixed cutter blade, the top surface of the divider wall, and the top surface of the cover when the cover is in a closed position across said first recess being coplanar; and a movable cutter blade pivotally mounted to said base and defining a lower, second cutting edge arranged to cut paper extending outwardly from said top surface of said fixed cutter blade.

13. The paper trimmer of claim 12 wherein said base includes a ledge inwardly of said upstanding wall for supporting an edge of said cover adjacent said upstanding wall.

14. The paper trimmer of claim 12 wherein said base includes a ledge extending about said first recess and having a portion inwardly of said upstanding wall for supporting an edge of said cover adjacent said upstanding wall.

15. The paper trimmer of claim 12 wherein said upstanding wall is formed integrally with said base.

16. A paper trimmer comprising:

a base formed of molded synthetic resin having a front portion defining a first upwardly opening recess, a rear portion defining a second upwardly opening recess, and an edge portion;

a cover formed of molded synthetic resin removably overlying said first recess;

a fixed cutter blade formed of metal on said base edge portion and defining a top surface and an outer, first, cutting edge; and a movable cutter blade formed of metal pivotally mounted to said base and defining a lower, second cutting edge arranged to cut paper extending outwardly from said top surface of said fixed cutter blade.

17. The paper trimmer of claim 16 wherein a handle formed of molded synthetic resin is pivotally mounted to said base and said movable cutter blade is mounted thereto.

18. The paper trimmer of claim 16 wherein a handle formed of molded synthetic resin is pivotally mounted to said base and said movable cutter blade is mounted thereto.

19. The paper trimmer of claim 16 wherein a handle formed of molded synthetic resin is pivotably mounted to said base and said movable cutter blade is mounted thereto, said fixed and movable blades being formed of metal.

* * * * *